US010112790B2

(12) United States Patent
Hayashi et al.

(10) Patent No.: US 10,112,790 B2
(45) Date of Patent: Oct. 30, 2018

(54) FEEDING APPARATUS

(71) Applicant: Funai Electric Co., Ltd., Osaka (JP)

(72) Inventors: Akira Hayashi, Kakogawa (JP); Shoichi Fukuyama, Hirakata (JP); Kenro Ueno, Nara (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 15/720,578

(22) Filed: Sep. 29, 2017

(65) Prior Publication Data

US 2018/0093840 A1 Apr. 5, 2018

(30) Foreign Application Priority Data

Sep. 30, 2016 (JP) ..... 2016-195055

(51) Int. Cl.
*B65H 3/52* (2006.01)
*B65H 3/34* (2006.01)
(Continued)

(52) U.S. Cl.
CPC ..... *B65H 3/34* (2013.01); *B65H 3/0661* (2013.01); *B65H 3/0669* (2013.01);
(Continued)

(58) Field of Classification Search
CPC ..... B65H 1/02; B65H 3/06; B65H 3/0653; B65H 3/0661; B65H 3/0676;
(Continued)

(56) References Cited

U.S. PATENT DOCUMENTS 8,052,139 B1 * 11/2011 Su ..... B65H 3/0684 271/109
8,118,304 B1 * 2/2012 Chen ..... B65H 3/0684 271/245

(Continued)

FOREIGN PATENT DOCUMENTS

| | | | |
|---|---|---|---|
| EP | 2 481 695 | A2 | 8/2012 |
| JP | 2002-060080 | A | 2/2002 |
| JP | 2012-121701 | A | 6/2012 |

OTHER PUBLICATIONS

Extended European Search Report in counterpart European Application No. 17 19 1089.6 dated Mar. 2, 2018 (8 pages).

*Primary Examiner* — Prasad V Gokhale
(74) *Attorney, Agent, or Firm* — Osha Liang LLP

(57) ABSTRACT

A feeding apparatus includes a mounting portion that holds a medium; a feeding roller that feeds the medium toward a feeding direction; a stopper configured to prevent the medium from moving toward the feeding direction; a supporting part that swings the feeding roller between: a first position in which the feeding roller feeds the medium while both the feeding roller and the stopper contact the medium, and a second position in which the feeding roller does not contact the medium while the stopper contacts the medium to prevent the medium from moving toward the feeding direction; and a regulating part disposed on a downstream side in feeding direction with respect to a supporting point of the supporting part. The regulating part regulates movement of the stopper by contacting a portion of the stopper that does not contact the medium in the first position.

15 Claims, 11 Drawing Sheets

(51) Int. Cl.
*B65H 3/06* (2006.01)
*B65H 3/56* (2006.01)

(52) U.S. Cl.
CPC ..... *B65H 3/0684* (2013.01); *B65H 3/56* (2013.01); *B65H 2404/725* (2013.01)

(58) Field of Classification Search
CPC ..... B65H 3/0684; B65H 3/34; B65H 3/56; B65H 3/565; B65H 2404/725
See application file for complete search history.

(56) References Cited

U.S. PATENT DOCUMENTS

| | | | | |
|---|---|---|---|---|
| 2002/0074711 | A1* | 6/2002 | Higaki ..... | B65H 3/0615 271/117 |
| 2008/0197560 | A1* | 8/2008 | Lee ..... | B65H 3/0684 271/121 |
| 2009/0273137 | A1 | 11/2009 | Chen et al. | |
| 2012/0261878 | A1* | 10/2012 | Lai ..... | B65H 3/0684 271/227 |
| 2013/0241139 | A1* | 9/2013 | Hayakawa ..... | B65H 3/0684 271/117 |

* cited by examiner

Paper Feeding Position (Paper Feeding State)

Paper Feeding Position
(Paper Feeding State)

800-800 Line Cross Section

Retreating Position (Non-Paper Feeding State)

Paper Feeding Position (Paper Feeding State)

900-900 Line Cross Section

First Example

Second Example

Third Example

Fourth Example

Paper Feeding Position
(Paper Feeding State)

Variation

FEEDING APPARATUS

BACKGROUND OF THE INVENTION

Technical Field

The present invention relates to a feeding apparatus, and particularly to a feeding apparatus provided with a paper feeding roller and a sheet stopper.

Related Art

It is known that some conventional feeding apparatuses have both a paper feeding roller and a sheet stopper (for example, see patent literature 1).

A feeding apparatus disclosed in patent literature 1 has a housing, a paper feeding roller that can move to a retracting position in which paper can be set and a paper feeding position in which the paper can be fed, and a sheet stopper for the paper. The paper feeding roller and stopper, respectively, are pivotably attached to the housing via different shaft parts. A hole-shaped regulating part is provided on the housing, and the stopper has an engagement mechanism that engages with the hole-shaped regulating part. Note that the stopper is configured to prevent the paper from being pressed downstream in the paper feeding path from the predetermined set position.

When the paper feeding roller is in the retracting position in the feeding apparatus, the stopper is disposed on the paper feeding path engaged to the regulating part, and becomes a state in which paper cannot be fed (non-paper feeding state). Also, the feeding apparatus is configured so that the engagement with the regulating part (housing) of the engagement mechanism is disengaged while the paper feeding roller is moving when the paper feeding roller moves from the retreating position to the paper feeding position. As a result, it is possible for the stopper to be pressed by the paper fed by the paper feeding roller and removed from the paper feeding path, and the feeding apparatus becomes a state in which paper can be fed (paper feeding state).

PATENT LITERATURE

Patent Literature 1: Japanese Unexamined Patent Application Publication No. 2012-121701

SUMMARY

However, in the feeding apparatus in patent literature 1, because the paper feeding roller and stopper are separately attached to the housing via different shaft parts to be able to move, and it is necessary to disengage the engagement with the regulating part (housing) of the engagement mechanism of the stopper while the paper feeding roller is moving when the paper feeding roller moves from the retreating position to the paper feeding position, the configuration becomes complicated for withdrawing the stopper from the paper feeding path along with the movement of the paper feeding roller from the retreating position to the paper feeding position.

In light of the above, one or more embodiments of the present invention provide a feeding apparatus that can regulate a medium by moving a paper feeding roller and a stopper in a simple configuration.

The feeding apparatus according to one aspect of the present invention is provided with a mounting portion for mounting a medium, a paper feeder having a rotatably provided paper feeding roller and a pivotably provided stopper, a supporting part for swinging the paper feeder between a first position in which the paper feeding roller can feed the medium and a second position in which the stopper can regulate the medium, and a regulating part for regulating movement of the stopper. The regulating part is disposed further on a downstream side of a conveying direction of the medium than a supporting point of the supporting part. The regulating part regulates movement by contacting the stopper on a different portion than the portion in which the stopper contacts the medium in the first position.

In the feeding apparatus according to one aspect of the present invention, a mounting portion for mounting a medium, a paper feeder having a rotatably provided paper feeding roller and a pivotably provided stopper, and a supporting part for swinging the paper feeder between a first position in which the paper feeding roller can feed the medium and a second position in which the stopper can regulate the medium are provided. By this, because the paper feeding roller and the stopper which make up the paper feeder are integrally rocked by the supporting part, the configuration can be made simpler compared to a case in which the paper feeding roller and the stopper are rocked separately. Furthermore, because the stopper rocks along with the paper feeding roller by the supporting part, it is no longer necessary to provide a configuration such as the conventional engagement mechanism for regulating or removing regulations of the movement of the stopper while the paper feeding roller is moving. Furthermore, because the stopper can be pivoted without being regulated by the regulating part by moving the stopper to a position in which pivoting is not regulated by the regulating part when the paper feeding roller is moved to the first position, the stopper can be withdrawn from the paper feeding path. Additionally, because it is configured so that the pivoting of the stopper is regulated by the regulating part by moving the stopper to a position in which pivoting is regulated by the regulating part on the paper feeding path when the paper feeding roller is moved to the second position, the stopper can be regulated from pivoting further from the second position. By the above, the medium can be regulated by moving the paper feeding roller and the stopper by a simple configuration.

In the feeding apparatus according to one aspect of the present invention, the length from the pivotal center of the stopper to the tip end portion (the pivot radius of the stopper) may be shorter than the distance between the pivotal center of the stopper in the first position and the regulating part, and longer than the distance between the pivotal center of the stopper in the second position and the regulating part. If configured in this manner, because it is possible to switch between a state in which the stopper reaches the regulating part from the shaft part side and a state in which it does not reach simply by moving the stopper along with the paper feeding roller so that the magnitude correlation of the pivot radius of the stopper and the distance between the pivotal center of the stopper and the regulating part changes, the stopper can be withdrawn from the paper feeding path. As a result, the paper feeding roller and the stopper can be easily moved by a simple configuration.

In the feeding apparatus according to one aspect of the present invention, the rotational center of the paper feeding roller and the pivotal center of the stopper may be disposed in substantially the same position. If configured in this manner, it is possible to move the paper feeding roller and the stopper in a simpler configuration than when the pivotal center of the stopper and the rotational center of the paper feeding roller are in different positions by making them in common with the shaft part.

In this case, the supporting part may include a pivotal center on which the supporting part pivots and a shaft part that becomes the rotational center of the paper feeding roller, and the supporting part may swing the shaft part between the first position and the second position by pivoting around the pivotal center.

In the configuration described above in which the supporting part swings between the first position and the second position along with the pivoting of the shaft part, the supporting part may have a pivotal center or pivotal axis on which the supporting part pivots, and the pivotal center or pivotal axis of the supporting part may be disposed more upstream in the conveying direction of the medium than the regulating part. If configured in this manner, because it is possible to easily change the height position of the stopper moving along with the paper feeding roller by the pivoting of the supporting part when a distance has been ensured between the paper feeding roller and the pivotal center of the supporting part, and when it is configured so that the stopper is positioned in a position higher than the regulating part when the paper feeding roller is on the first position, and it is configured so that (a portion of) the stopper is positioned in a position lower than the regulating part when the paper feeding roller is on the second position, it is possible to easily regulate the movement of the stopper along with the change of height position of the stopper.

In the feeding apparatus according to one aspect of the present invention, the regulating part may be provided on the housing. If configured in this manner, it is possible to regulate the movement of the stopper by the regulating part provided on the housing.

In this case, an opening portion may be provided on the housing, and the regulating part may be formed at an edge portion of the opening portion in the downstream side in the conveying direction of the medium. If configured in this manner, because the regulating part is configured by simply providing the opening portion on the housing, it is possible to regulate movement of the stopper, or carry out a removing of regulations of movement of the stopper by a simpler configuration.

In the configuration described above in which the regulating part is provided on the housing, the supporting part may include a shaft part which is the rotational center of the paper feeding roller, and the stopper may include an attaching portion that passes through the shaft part, and a contacting portion that contacts the medium. If configured in this manner, because the stopper and the paper feeding roller can be made in common via the shaft part by the attaching portion, the stopper can be securely moved along with the paper feeding roller.

In the configuration described above in which the stopper includes an attaching portion and a contacting portion, the attaching portion may have a gap between itself and the shaft part. If configured in this manner, the stopper can be suppressed from pivoting in conjunction with the rotation of the shaft part when the paper feeding roller is rotated. As a result, the stopper can be suppressed from being disposed further downstream in the conveying direction than the regulating part in the second position.

In the configuration described above in which the stopper includes an attaching portion and a contacting portion, the contacting portion may have a shape rounded on the side contacting the medium. If configured in this manner, the medium is suppressed from being damaged by the contacting portion.

In the configuration described above in which the stopper includes an attaching portion and a contacting portion, the shaft part may include a grease disposing portion for applying grease, and the stopper may be disposed in a different location from the grease disposing portion. If configured in this manner, because the grease disposing portion is separated from the sliding portion of the stopper and the shaft part, grease is suppressed from adhering to the sliding portion of the stopper and the shaft part. As a result, the stopper is suppressed from becoming difficult to pivot with respect to the shaft part due to the viscosity of the grease.

In the configuration described above in which the stopper includes an attaching portion and a contacting portion, the supporting part may include a main body unit that rotatably supports the shaft part, and the stopper is disposed between the main body unit and the paper feeding roller in the axial direction of the shaft part. If configured in this manner, when the shaft part is in a cantilever shape here, the position displacement in the left and right direction generally becomes larger the more the position is separated from the main body unit (base) on the shaft part due to the shaking of the main body unit. Therefore, if configured in this manner, because it is possible to dispose the stopper near the main body unit (near the base) of the shaft part when the shaft part is a cantilever shape, position displacement in the front-back direction of the stopper from the main body unit side (base side) of the shaft part can be suppressed.

In the configuration described above in which the stopper includes an attaching portion and a contacting portion, the shaft part may have a biasing portion, and the biasing portion energizes the stopper toward the mounting portion. If configured in this manner, the (tip end portion of the) stopper is suppressed from being disposed further on the downstream side in the conveying direction of the medium than the regulating part due to the biasing portion. In other words, when the paper feeding roller is in the second position (state in which the medium is installed), the stopper can be prevented from withdrawing from the paper feeding path without the stopper being regulated by the regulating part. That is, the stopper is suppressed from not functioning when the medium is being installed.

In the configuration described above in which the stopper includes an attaching portion and a contacting portion, the mounting portion may include a friction portion and a sliding portion that contact the medium, and the stopper is disposed between the friction portion and the sliding portion in the axial direction of the shaft part.

In the configuration described above in which the stopper includes an attaching portion and a contacting portion, the supporting part may support the paper feeding roller from both sides in the axial direction of the shaft part, the paper feeding roller and the stopper are provided in a number of two or more, and the paper feeding roller is disposed in a position sandwiching the stopper.

In the feeding apparatus according to one aspect of the present invention, the supporting part is configured to carry out a predetermined operation for moving the paper feeding roller from the second position to the first position and afterward moving it from the first position to the second position every time a paper feeding operation is completed. If configured in this manner, the stopper can be returned to the initial position (upstream side in the conveying direction of the regulating part) along with the movement of the stopper to the second position by the supporting part.

According to one or more embodiments of the present invention, it is possible to provide a feeding apparatus that can regulate a medium by moving a paper feeding roller and a stopper by a simple configuration.

DETAILED DESCRIPTION

Below, embodiments of the present invention will be described referring to drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Example

The configuration of an image forming apparatus 100 according to one or more embodiments of the present invention will be described referring to FIG. 1 to FIG. 7. Note that the image forming apparatus 100 is one example of a "feeding apparatus" in the scope of the patent claims.

(Configuration of the Image forming Apparatus)

Figure 1:
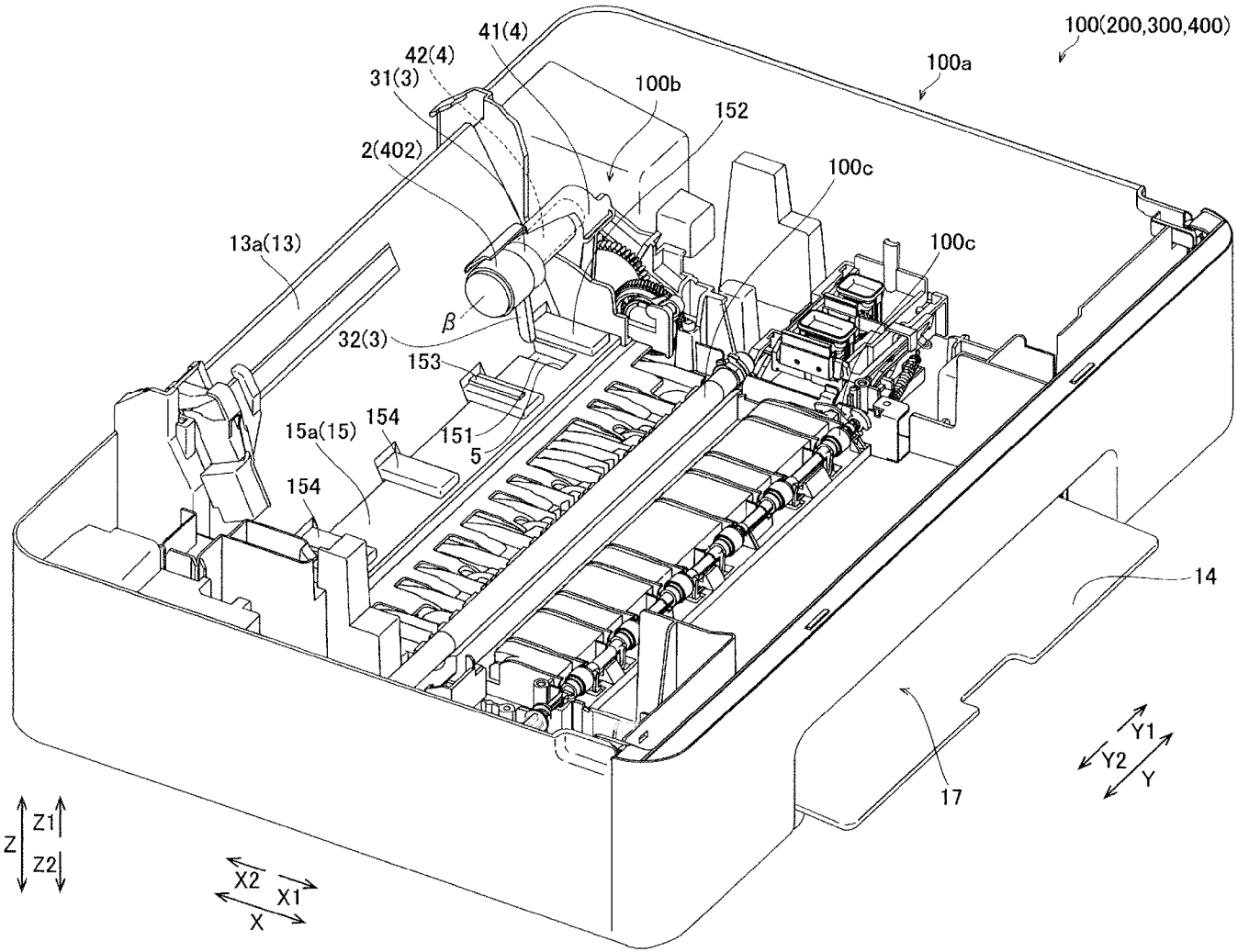
FIG. 1 is a perspective view illustrating the internal configuration of the image forming apparatus according to one or more embodiments of the present invention.

As illustrated in FIG. 1, the image forming apparatus 100 according to one or more embodiments of the present invention is provided with a housing 100*a* including a paper feeding tray 13, a paper ejecting tray 14, and a base plate 15. Furthermore, the image forming apparatus 100 is provided with a paper feeder 100*b* including a paper feeding roller 2 and a stopper 3, a conveying roller 100*c* (see FIG. 2), and a printing portion 100*d* (see FIG. 2) in the housing 100*a*. Note that the paper feeding tray 13 is one example of a "mounting portion."

The image forming apparatus 100 is configured to feed sheets P, which is the object to undergo a printing installed on the paper feeding tray 13 (first face 13*a* described later) from a paper feeding port 16 (see FIG. 2) of the housing 100*a* by the paper feeder 100*b*. Furthermore, the image forming apparatus 100 conveys the fed sheet P along the paper feeding path using the conveying roller 100*c*. Furthermore, the printing portion 100*d* is configured to print a predetermined image on the sheet P being conveyed. The image forming apparatus 100 is configured so that the sheet P having a predetermined image printed thereon is ejected from a paper ejecting port 17 of the housing 100*a*. Note that the sheet P is one example of a "medium."

The image forming apparatus 100 is configured so that the sheets P disposed on the paper feeding tray 13 are regulated not to be inserted in the conveying direction (downstream in the conveying direction) with respect to the predetermined position by obstructing the paper feeding path with a stopper 3 described hereinafter in the non-paper feeding state (state in which the paper feeding roller 2 is disposed in the retreating position). Details will be described hereinafter. Note that the retreating position is one example of a "second position."

In the description below, the driving direction of the printing portion 100*d* is the Y direction, and on the printing surface, the direction orthogonal to the Y direction is the X direction, and the direction orthogonal to the X direction and the Y direction is the Z direction.

(Configuration of the Housing)

Figure 2:
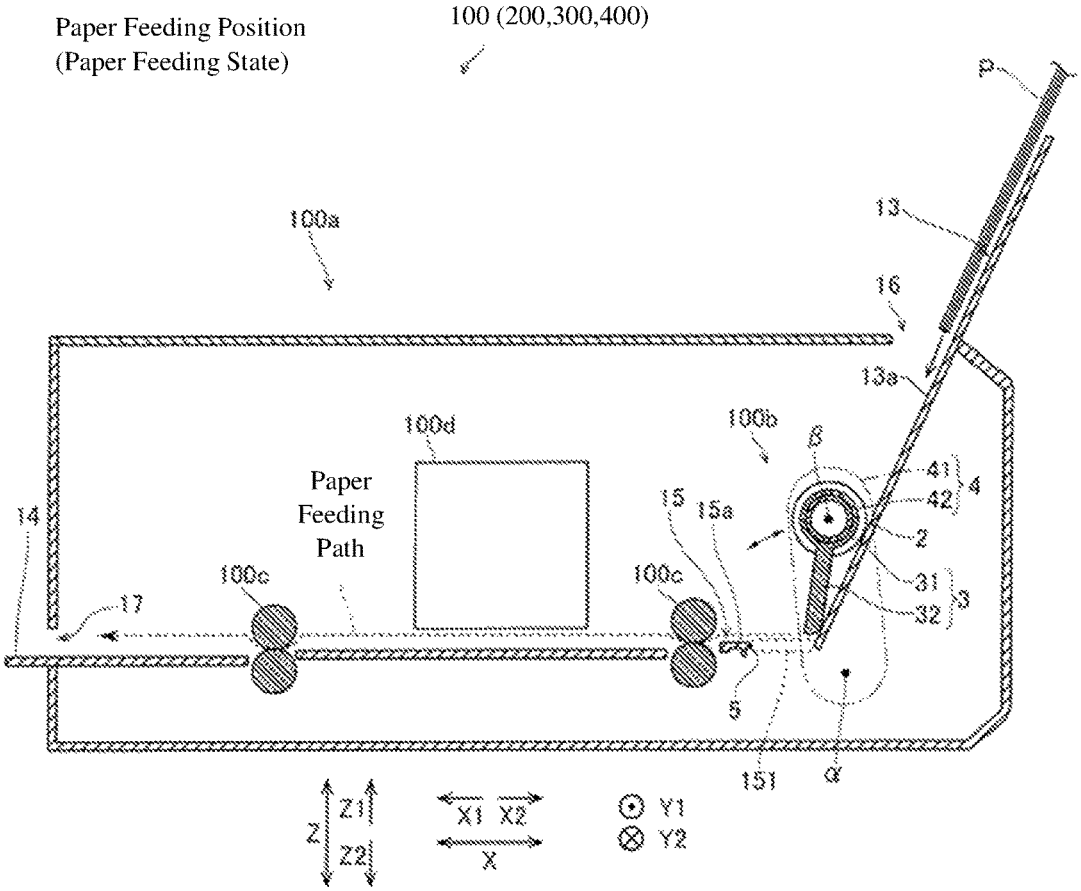
FIG. 2 is a schematic cross-sectional view illustrating the entire configuration of the image forming apparatus according to one or more embodiments of the present invention.

The housing 100*a* is formed in a rectangular parallelepiped shape as illustrated in FIG. 2. The paper feeding tray 13 and the paper ejecting tray 14 are respectively disposed on the back side (X2 direction side) and the front side (X1 direction side) in the housing 100*a*. Moreover, the paper feeding tray 13 extends diagonally back and upward. Furthermore, the paper ejecting tray 14 extends nearly horizontally. Also, the paper ejecting tray 14 is configured so that a portion of the front can protrude from the housing 100*a* (paper ejecting port 17). Moreover, the paper feeding port 16 is provided between the paper feeding tray 13 and the upper portion of the housing 100*a*. Furthermore, the paper feeding port 17 is provided on the downward side of the front portion of the housing 100*a*.

The front surface of the paper feeding tray 13 (surface on the X1 direction side) is configured so that the sheets P are installed via the paper feeding port 16, and is configured to have a first surface 13*a* that is inclined from the horizontal direction. Furthermore, the base plate 15 extends in a nearly horizontal direction from the bottom end of the paper feeding tray 13, and extends to the front (X1 direction). The upper surface of the base plate 15 is configured having a second surface 15*a* contacting the bottom end of the sheets P installed on the first surface 13*a*. The first surface 13*a* and the second surface 15*a* make an obtuse angle. In other words, the image forming apparatus 100 is a so-called L-pass type feeding apparatus that feeds paper by moving the sheets P installed on a diagonally tilted surface in a nearly horizontal direction.

Figure 3:
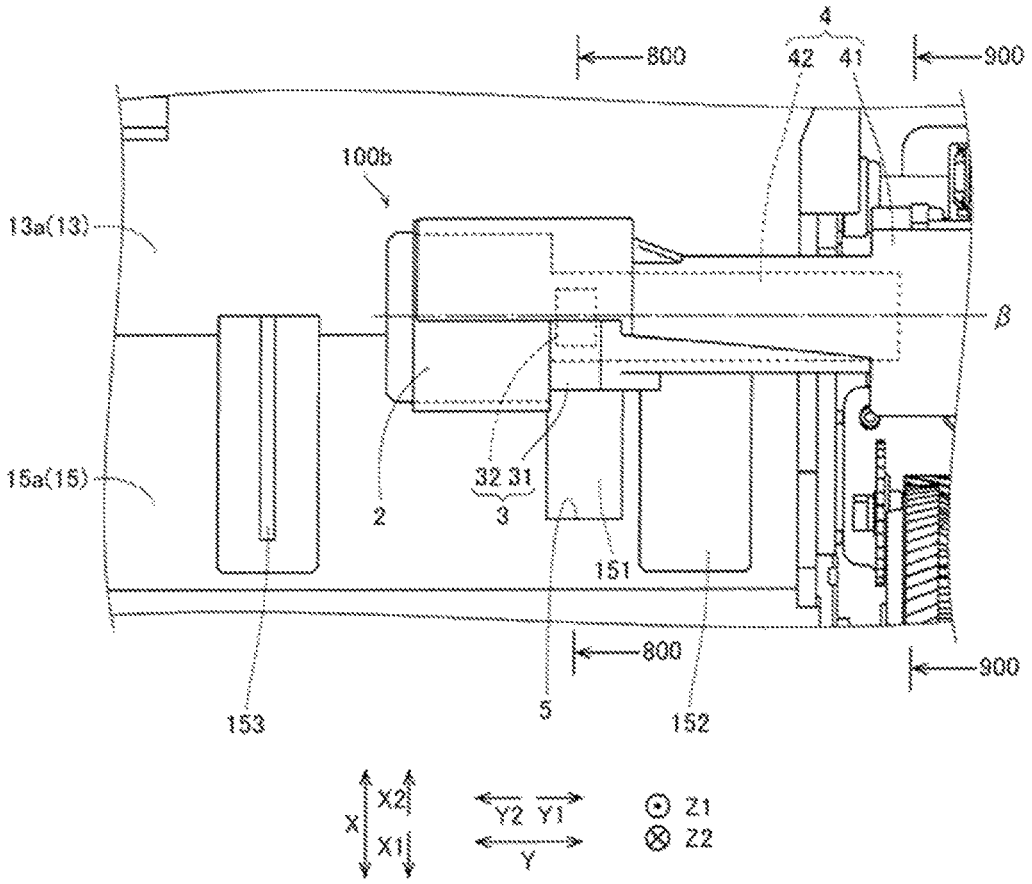
FIG. 3 is a planar view illustrating the paper feeder of the image forming apparatus according to one or more embodiments of the present invention.

As illustrated in FIG. 1, the second surface 15*a* includes a sliding portion 152 and a friction portion 153 contacting the bottom end of the sheet P installed on the first surface 13*a*. The sliding portion 152 and the friction portion 153 are configured to separate the sheets P due to a difference in friction coefficient. The sliding portion 152 and the friction portion 153 are formed in a flat plate extending forward from the connection portion of the base plate 15 and the paper feeding tray 13. The sliding portion 152 is formed by a material having a relatively small friction coefficient, and has a function of allowing the sheet P to easily slide to the downstream side of the conveying direction of the paper feeding path while feeding paper. The friction portion 153 has a rubber portion provided on the upper surface side (Z1 direction side), and regulates movement of the bottom end of the sheet P to the downstream side of the conveying direction of the by this rubber portion. Furthermore, the friction portion 153 has the function of causing only the uppermost sheet P to be lifted up along with the rotation of the paper feeding roller 2. By this, the friction portion 153 suppresses so-called multi feed, wherein a plurality of sheets P are fed at one time. Furthermore, the sliding portion 152 and the friction portion 153 are disposed to sandwich the paper feeding roller 2 and the stopper 3 in the width direction (axial direction (Y direction) of an axis portion or shaft part 42 described hereinafter) as illustrated in FIG. 3. Note that the sliding portion 152 is disposed on the Y1 direction side of the paper feeding roller 2 and the stopper 3, and the friction portion 153 is disposed on the Y2 direction side of the paper feeding roller 2 and the stopper 3. Note that another sliding portion 154 is provided on the Y2 direction side of the friction portion 153, separated from the friction portion 153 having a predetermined gap. Furthermore, a rectangular opening portion 151 is disposed on the second surface 15*a*. The opening portion 151 is disposed slightly more on the Y1 direction side than the paper feeding roller 2 in the width direction (Y direction). Moreover, the opening portion 151 is disposed sandwiched by the friction portion 153 and the sliding portion 152 in the width direction (Y direction).

(Configuration of the Paper Feeder)

Figure 4:
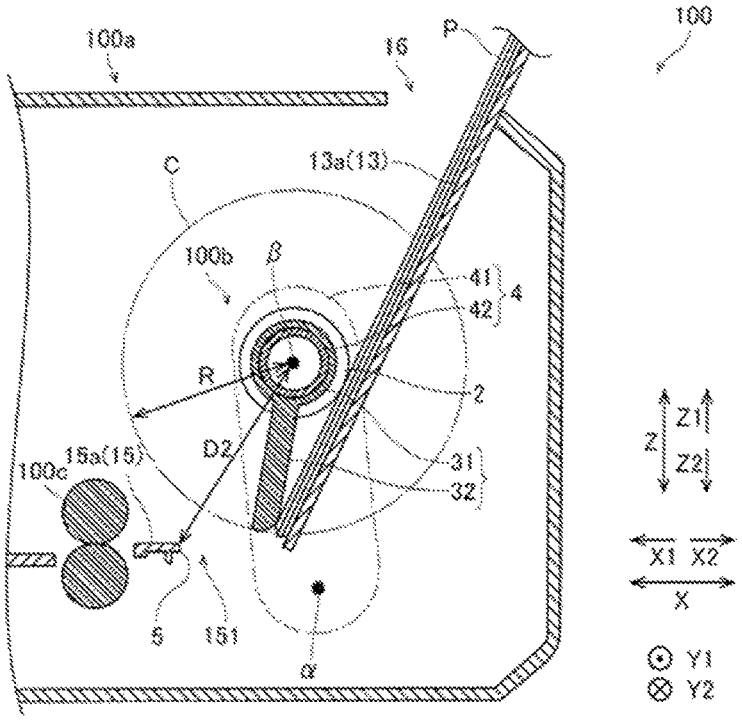
FIG. 4 is a cross-sectional view along the 800-800 line in FIG. 3, and illustrates the paper feeding state of the image forming apparatus according to one or more embodiments of the present invention.
Figure 5:
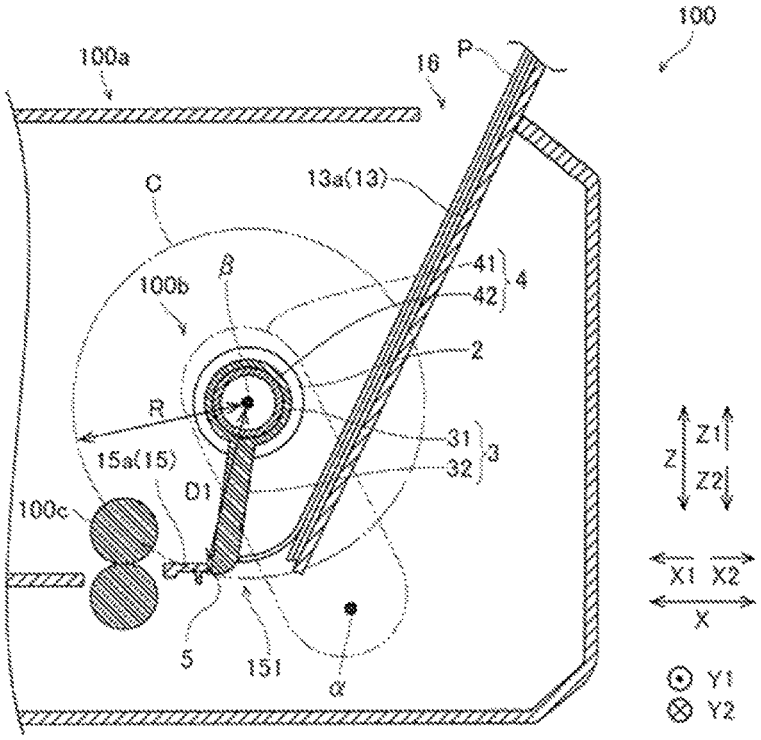
FIG. 5 is a diagram illustrating the non-paper feeding state of the image forming apparatus according to one or more embodiments of the present invention.

The paper feeder 100*b* includes the paper feeding roller 2 and the stopper 3 as illustrated in FIG. 2. Furthermore, a supporting part 4 having a main body unit 41 and a shaft part 42, and a regulation unit 5 are provided in the housing 100*a*. The supporting part 4 pivotably supports the paper feeding roller 2 as illustrated in FIG. 4 and FIG. 5. For example, the shaft part 42 of the supporting part 4 pivotably supports the paper feeding roller 2 in the vicinity of the end portion on the Y2 direction side. The stopper 3 is pivotably attached to the shaft part 42 of the supporting part 4.

Figure 6:
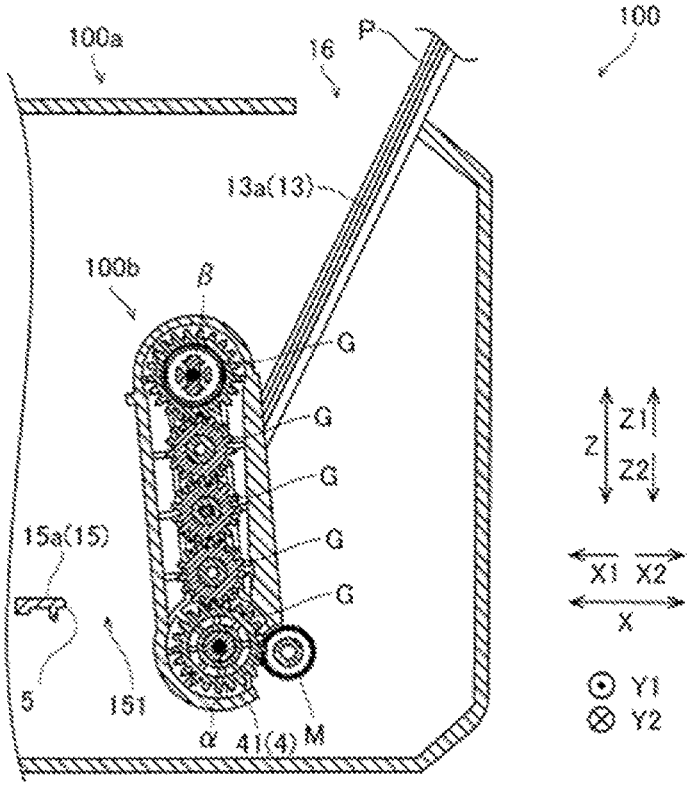
FIG. 6 is a cross-sectional view along the 900-900 line in FIG. 3.

The main body unit 41 is disposed on the Y1 direction side of the paper feeding tray 13. That is, the supporting part 4 is configured in a cantilever shape to support the paper feeding roller 2 from one side (Y1 direction side) of the axial direction (Y direction) of the shaft part 42. Furthermore, the main body unit 41 is formed in a bag shape viewed from the Y direction. Furthermore, the main body unit 41 is attached to the housing 100*a* near the bottom end so as to swing (pivot). The pivotal center (line) α of the main body unit 41 (supporting part 4) is disposed further upstream on the conveying direction of the sheet P than the regulating part 5. Furthermore, the pivotal center (line) α of the main body unit 41 (supporting part 4) is disposed further on the lower side than the second surface 15*a*, and is disposed on the back surface (surface opposite the first surface 13*a* of the paper feeding tray 13) side of the first surface 13*a*. Furthermore, the main body unit 41 is connected near the upper end so that the shaft part 42 can rotate from the Y2 direction side. Furthermore, the main body unit 41 is configured having a plurality of gears G to transmit the driving force from the motor M to the shaft part 42 via the plurality of gears G as illustrated in FIG. 6.

The shaft part 42 extends in the width direction (Y direction) as illustrated in FIG. 3. Furthermore, the shaft part 42 has the paper feeding roller 2 provided on one end portion of the Y2 direction. Moreover, the shaft part 42 has the other end portion in the Y1 direction connected to the main body unit 41. Furthermore, the shaft part 42 is configured to be the rotational center (line) β of the paper feeding roller 2. Moreover, the stopper 3 is pivotably connected to the shaft part 42.

The paper feeding roller 2 is provided opposing the first surface 13*a* as illustrated in FIG. 4. Furthermore, the paper feeding roller 2 is disposed on the upper side of the second surface 15*a*. Note that the second surface 15*a* may be either integrated or separate from the housing 100*a*.

Here, a configuration will be simply described wherein the paper feeding roller 2 is rocked (pivoted) by the supporting part 4. The supporting part 4 is configured to be able to rock (move) the paper feeding roller 2 between the paper feeding position and the retreating position by rocking the shaft part 42 (see FIG. 4) around the pivotal center α (rocking between the position of the shaft part 42 illustrated in FIG. 4 and the position of the shaft part 42 illustrated in FIG. 5). The paper feeding position is the position of the paper feeding roller 2 in which the sheet P can be fed. For example, while the motor M (see FIG. 6) is being driven, the paper feeding roller 2 is energized by the driving force of the motor M on the sheet P side or the first surface 13*a* side on the paper feeding position. The retreating position is the position of the paper feeding roller 2 in which the sheet P cannot be fed, as illustrated in FIG. 5. For example, while the motor M is being driven, the paper feeding roller 2 is energized by the driving force of the motor M on the side opposite the sheet P or the side opposite the first surface 13*a*. Therefore, the paper feeding roller 2 in the retreating position is separated from the sheet P (first surface 13*a*). Furthermore, the paper feeding roller 2 is rotatably supported on the shaft part 42 of the supporting part 4. Furthermore, the paper feeding roller 2 is attached and fixed to the shaft part 42. Because of this, the paper feeding roller 2 is configured to rotate along with the rotation of the shaft part 42. Note that the paper feeding position is one example of a "first position."

The regulating part 5 is an edge portion of the downstream side (X1 direction size) in the conveying direction of the opening portion 151 provided on the second surface 15*a*. The regulating part 5 is disposed further downstream on the conveying direction of the paper feeding path than the pivotal center (line) α of the main body unit 41 (supporting part 4). Furthermore, the regulating part 5 has the function of regulating the pivoting of the stopper 3 from the downstream side of the conveying direction, and is configured to regulate pivoting downstream in the conveying direction of the stopper 3 (pivoting in the clock-wise direction when viewing from the Y1 direction) by contacting the stopper 3 in the non-paper feeding state (state in which the paper feeding roller 2 is disposed in the retreating position). Note that the regulating part 5 does not regulate pivoting to the downstream side of the conveying direction of the stopper 3 in the paper feeding state (state in which the paper feeding roller 2 is in the paper feeding position) as illustrated in FIG. 4. Furthermore, the regulating part 5 regulates movement by contacting the stopper 3 on a portion different than the portion wherein the stopper 3 contacts the sheet P in the paper feeding position.

The pivotal center line of the stopper 3 is substantially the same as the rotational center β of the paper feeding roller 2. By configuring in this manner, the position of the stopper 3 changes along with the movement of the paper feeding roller 2. The stopper 3 is configured so that movement to the downstream side in the conveying direction is regulated by contacting the regulating part 5 (end portion of the downstream side in the conveying direction of the opening portion 151) from the upstream side in the conveying direction (from the inner side of the opening portion 151). As a result, the stopper 3 is configured to stop at the paper feeding path (obstructing the paper feeding path), and stop movement to the downstream side of the conveying direction of the (bottom end) of the sheet P. Furthermore, the stopper 3 is configured so that a side (generally the X2 direction side) opposite the side that contacts the regulating part 5 (generally the X1 direction side) contacts the sheet P, and is configured to stop movement of the sheet P.

The stopper 3 is configured to move to the position in which pivoting is regulated by the regulating part 5 on the paper feeding path when the paper feeding roller 2 has moved to the retreating position. Moreover, the stopper 3 is configured to obstruct the paper feeding path so that paper feeding cannot be done. The stopper 3 is also configured to move to a position in which pivoting is not regulated by the regulating part 5 when the paper feeding roller 2 has moved to the paper feeding position.

Figure 7:
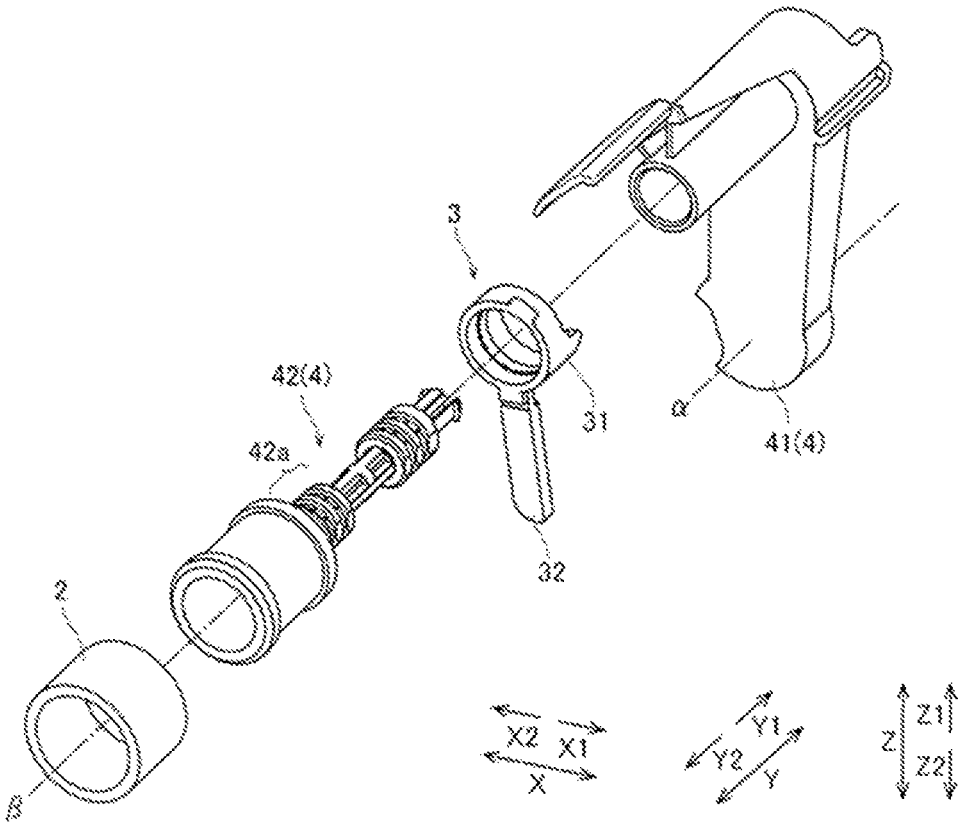
FIG. 7 is an exploded perspective view of the paper feeder of the image forming apparatus according to one or more embodiments of the present invention.

The stopper 3 is disposed between the main body unit 41 and the paper feeding roller 2 in the axial direction of the shaft part 42 of the supporting part 4 as illustrated in FIG. 7. In other words, the stopper 3 is disposed on a position closer to the supporting part 4 than the paper feeding roller 2.

The stopper 3 has an attaching portion 31 and a contacting portion 32.

The attaching portion 31 is formed in a tube shape. Furthermore, the attaching portion 31 is attached to the shaft part 42 by the shaft part 42 of the supporting part 4 being passed through it. Moreover, the inner diameter of the attaching portion 31 is slightly larger than the outer diameter of a portion 42*a* in which the attaching portion of the shaft part 42 is attached. In other words, there is a slight gap between the attaching portion 31 and the shaft part 42. Because of this, direct torque is applied from the shaft part 42 as with the paper feeding roller 2 in the attaching portion 31 when the shaft part 42 rotates, and rotation of the attaching portion 31 does not occur along with the shaft part 42 around the rotational center (line) β. Furthermore, the attaching portion 31 is disposed adjacent to the Y1 direction side of the paper feeding roller 2.

The contacting portion 32 is formed in a rod shape. As illustrated in FIG. 4 and FIG. 5, the contacting portion 32 is formed in a circular shape having the surface contacting the sheet P rounded so that the sheet P is not damaged. For example, the contacting portion 32 has a shape in which the X2 direction side (side contacting the sheet P) is rounded when viewing from the Y direction. Furthermore, the contacting portion 32 is generally disposed to extend downward due to its own weight in a state in which force is not applied from an external configuration such as the sheet P. Furthermore, the tip end portion (bottom end portion) of the contacting portion 32, as shown in FIG. 5, is always disposed further on the downward side than the regulating part 5 when the paper feeding roller 2 is in the retreating position.

The contacting portion 32 is generally disposed on the paper feeding path. However, the contacting portion 32 is configured to be pressed to the bottom end of the sheet P when paper feeding begins in the paper feeding state (when the paper feeding roller 2 is in the paper feeding position), to pivot to the downstream side of the conveying direction (pivot in the clock-wise direction when viewing from the Y1 direction), and to move (get out of the way) from the paper feeding path.

The contacting portion 32 is disposed in the inner side of a range in which the opening portion 151 (regulating part 5) is provided in the width direction (axial direction, Y direction of the shaft part 42) as illustrated in FIG. 3. Furthermore, the contacting portion 32 is always disposed in a position to overlap with the opening portion 151 in a planar view.

(Relationship Between the Pivoting of the Supporting Part and the Positions of the Regulating Part and the Stopper)

Next, the relationship between the pivoting of the supporting part 4 and the positions of the regulating part 5 and the stopper 3 will be described referring to FIG. 4 and FIG. 5.

The supporting part 4 rocks between the paper feeding position and the retreating position by pivoting the shaft part 42. As illustrated in FIG. 4, the supporting part 4 moves the stopper 3 along with the paper feeding roller 2 so that the regulating part 5 is positioned on the outer side of a circular region C around the pivotal center (β) of the stopper 3 when the paper feeding roller 2 is moved to the paper feeding position (when moved from the non-paper feeding state to the paper feeding state) when viewing from a direction orthogonal to the pivoting direction of the stopper 3 (Y direction). Note that the circular region C is a region having a stopper pivot radius R, which is the distance between the pivotal center (β) of the stopper 3 and the end portion of the stopper 3.

Furthermore, as illustrated in FIG. 5, the supporting part 4 moves the stopper 3 along with the paper feeding roller 2 so that the regulating part 5 is positioned on the inner side of the circular region C when the paper feeding roller 2 is moved to the retreating position (when moved from the paper feeding state to the non-paper feeding state).

That is, as illustrated in FIG. 5, a distance D1 between the pivotal center (β) of the stopper 3 and the regulating part 5 is smaller than the stopper pivot radius R (D1<R) when the paper feeding roller 2 is in the retreating position (when in the non-paper feeding state).

Furthermore, as illustrated in FIG. 4, a distance D2 between the pivotal center of the stopper 3 and the regulating part 5 is larger than the stopper pivot radius R (D2>R) when the paper feeding roller 2 is in the paper feeding position (when in the paper feeding state).

(Operation of the Paper Feeding Roller and the Stopper)

Next, the operation of the stopper 3 will be described referring to FIG. 4 and FIG. 5.

First, as illustrated in FIG. 5, the paper feeding roller 2 is disposed in the retreating position and the sheet P is installed. In this non-paper feeding state, the tip end portion (bottom end portion) of the stopper 3 is provided on the inner side of the opening portion 151 with the regulating part 5 disposed on the edge portion of the downstream side in the conveying direction. Furthermore, in this non-paper feeding state, the stopper 3 contacts the regulating part 5 on the downstream side in the conveying direction by the stopper 3 being pressed to the downstream side in the conveying direction of the paper feeding path by the installed sheets P. Because of this, the stopper 3 has its pivot regulated by the regulating part 5. Note that even when the stopper 3 and the regulating part 5 are separated in the non-paper feeding state, the regulating part 5 is disposed in the pivotal range of the stopper 3, so the stopper 3 cannot pivot to the downstream side in the conveying direction past the regulating part 5. Therefore, because it is not possible to move (withdraw) the stopper 3 from the paper feeding path by the regulating part 5, it is not possible to insert the sheets P past a predetermined position when the paper feeding roller 2 is disposed in the retreating position. At this time, the regulating part 5 is positioned on the inner side of the circular region C.

When the printing operation is started by a user, the paper feeding roller 2 pivots to contact the front surface of the uppermost sheet P using the supporting part 4, and moves to the paper feeding position as illustrated in FIG. 4. In other words, the paper feeding roller 2 moves backward (X2 direction). Furthermore, because the stopper 3 is attached to the shaft part 42 of the supporting part 4 in the same manner as the paper feeding roller 2, it moves backward (X2 direction) in conjunction with the pivoting of the paper feeding roller 2. By this, it becomes in the paper feeding state. In other words, the stopper 3 moves due to the supporting part 4 so that the regulating part 5 is positioned on the outer side of the circular region C.

Then, the upper most sheet P moves to the downstream side of the conveying direction by the paper feeding roller 2 rotating around the rotational center (line) β. At this time, the stopper 3 withdraws from the paper feeding path by the bottom end of the uppermost sheet P pressing the stopper 3 to the downstream side of the conveying direction. Note that when withdrawing from the paper feeding path, the stopper 3 does not have its pivoting regulated by the regulating part 5 because the regulating part 5 is positioned on the outer side of the stopper pivot radius R. Paper feeding is carried out in this manner.

Effects of the First Example

In one or more embodiments of the first example, the following effects can be obtained.

In one or more embodiments the first example, as described above, a paper feeder 100*b* having a paper feeding tray 13 mounted with sheets P, a rotatably provided paper feeding roller 2, and a pivotably provided stopper 3, and a supporting part 4 that swings the paper feeder 100*b* between a paper feeding position in which the paper feeding roller 2 can feed the sheets P and a retreating position in which the stopper 3 can regulate the sheets P, are provided. By this, because the paper feeding roller 2 and the stopper 3 which make up the paper feeder 100*b* are integrally rocked by the supporting part 4, the configuration can be made simpler compared to a case in which the paper feeding roller 2 and the stopper 3 are rocked separately. Furthermore, because the stopper 3 rocks along with the paper feeding roller 2 by the supporting part 4, it is no longer necessary to provide a configuration such as the conventional engagement mechanism for regulating or removing regulations of the movement of the stopper 3 while the paper feeding roller 2 is moving. Furthermore, because the stopper 3 can be pivoted without being regulated by the regulating part 5 by moving the stopper 3 to a position in which pivoting is not regulated by the regulating part 5 when the paper feeding roller 2 is moved to the paper feeding position, the stopper 3 can be withdrawn from the paper feeding path. Additionally, because it is configured so that the pivoting of the stopper 3 is regulated by the regulating part 5 by moving the stopper 3 to a position in which pivoting is regulated by the regulating part 5 on the paper feeding path when the paper feeding roller 2 is moved in the retreating position, the stopper 3 can be regulated from pivoting further from the retreating position. By the above, sheets P can be regulated by moving the paper feeding roller 2 and the stopper 3 by a simple configuration.

In one or more embodiments of the first example, as described above, the length from the pivotal center of the stopper 3 to the tip end portion (the pivot radius of the stopper 3) is made shorter than the distance between the pivotal center of the stopper 3 in the paper feeding position and the regulating part 5, and longer than the distance between the pivotal center of the stopper 3 in the retreating position and the regulating part 5. By this, because it is possible to switch between a state in which the stopper 3 reaches the regulating part 5 from the shaft part 42 side and a state in which it does not reach simply by moving the stopper 3 along with the paper feeding roller 2 so that the magnitude correlation of the pivot radius of the stopper 3 and the distance between the pivotal center of the stopper 3 and the regulating part 5 changes, the stopper 3 can be withdrawn from the paper feeding path. As a result, the paper feeding roller 2 and the stopper 3 can be easily moved by a simple configuration.

In one or more embodiments of the first example, as described above, the rotational center β of the paper feeding roller 2 and the pivotal center of the stopper 3 can be disposed in substantially the same position. By this, it is possible to move the paper feeding roller 2 and the stopper 3 in a simpler configuration than when the pivotal center of the stopper 3 and the rotational center β of the paper feeding roller 2 are in different positions, by making them in common with the shaft part 42.

In one or more embodiments of the first example, as described above, a pivotal center α on which the supporting part 4 pivots, is provided on the supporting part 4, and the pivotal center α of the supporting part 4 is disposed more upstream in the conveying direction of the sheets P than the regulating part 5. By this, because it is possible to easily change the height position of the stopper 3 moving along with the paper feeding roller 2 by the pivoting of the supporting part 4 when a distance has been ensured between the paper feeding roller 2 and the rotational center α of the supporting part 4, and when it is configured so that the stopper 3 is positioned in a position higher than the regulating part 5 when the paper feeding roller 2 is on the paper feeding position, and it is configured so that (a portion of) the stopper 3 is positioned in a position lower than the regulating part 5 when the paper feeding roller 2 is on the retreating position, it is possible to easily regulate the movement of the stopper 3 along with the change of height position of the stopper 3.

In one or more embodiments of the first example, as described above, the regulating part 5 is provided on the housing 100*a*. By this, it is possible to regulate the movement of the stopper 3 by the regulating part 5 provided on the housing 100*a*.

In one or more embodiments of the first example, as described above, the opening portion 151 is provided on the housing 100*a*, and the regulating part 5 is made to be the edge portion of the downstream side in the conveying direction of the sheets P of the opening portion 151. By this, because the regulating part 5 is configured by simply providing the opening portion 151 on the housing 100*a*, it is possible to regulate movement of the stopper 3, or carry out a removing of regulations of movement of the stopper 3 by a simpler configuration.

In one or more embodiments of the first example, as described above, the shaft part 42 which is the rotational center β of the paper feeding roller 2 is provided on the supporting part 4, and the attaching portion 31 that passes through the stopper 3 and the shaft part 42, and the contacting portion 32 that contacts the sheet P are provided on the supporting shaft 4. By this, because the stopper 3 and the paper feeding roller 2 can be made in common via the shaft part 42 by the attaching portion 31, the stopper 3 can be securely moved along with the paper feeding roller 2.

In one or more embodiments of the first example, as described above, the attaching portion 31 is configured to have a gap between it and the shaft part 42. By this, the stopper 3 can be suppressed from pivoting in conjunction with the rotation of the shaft part 42 when the paper feeding roller 2 is rotated. As a result, the stopper 3 can be suppressed from being disposed further downstream in the conveying direction than the regulating part 5 in the retreating position.

In one or more embodiments of the first example, as described above, the contacting portion 32 is formed in a shape rounded on the side contacting the sheet P. By this, the sheet P is suppressed from being damaged by the contacting portion 32.

In one or more embodiments of the first example, as described above, the main body unit 41 that rotatably supports the shaft part 42 is provided on the supporting part 4, and the stopper 3 is disposed between the main body unit 41 and the paper feeding roller 2 in the axial direction of the shaft part 42. By this, when the shaft part 42 is in a cantilever shape here, the position displacement in the left and right direction generally becomes larger the more the position is separated from the main body unit 41 (base) on the shaft part 42 due to the shaking of the main body unit 41. Therefore, if configured as described above, because it is possible to dispose the stopper 3 near the main body unit 41 (near the base) of the shaft part 42 when the shaft part 42 is a cantilever shape, position displacement in the front-back direction of the stopper 3 from the main body unit 41 side (base side) of the shaft part 42 can be suppressed.

Second Example

Next, an image forming apparatus 200 in one or more embodiments of the second example will be described referring to FIG. 1 and FIG. 8. An example will be described in the second example in which the shaft part 42 has a grease disposing portion 42*b* in addition to the configuration of the first example. Note that the image forming apparatus 200 is one example of a "feeding apparatus."

Figure 8:
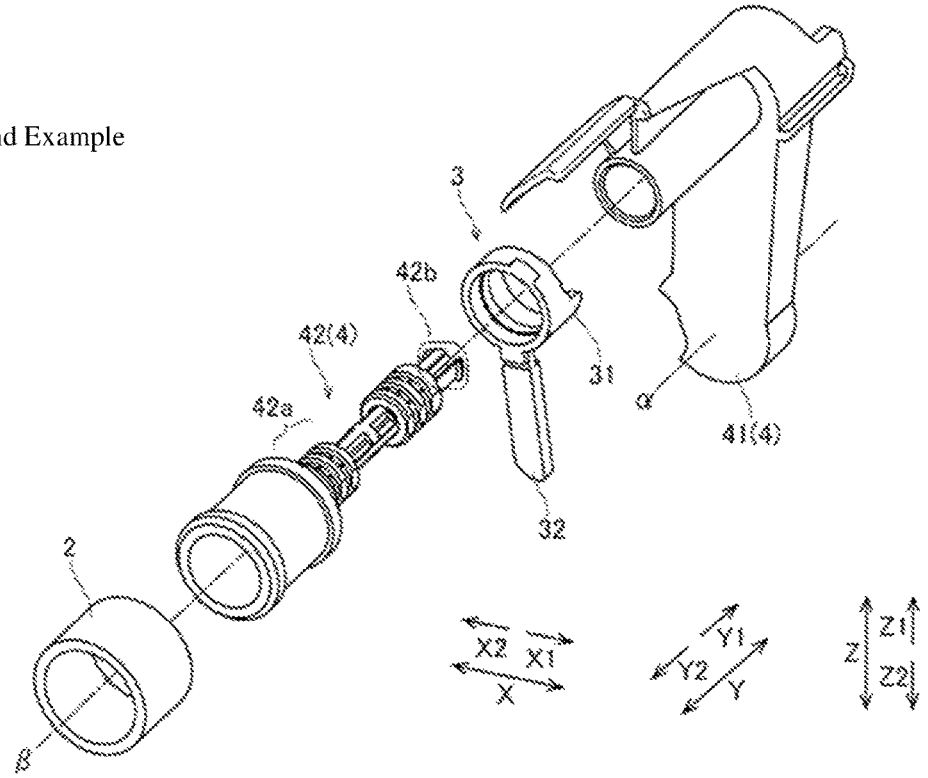
FIG. 8 is an exploded perspective view of the paper feeder of the image forming apparatus according to one or more embodiments of the present invention.

As illustrated in FIG. 8, in the image forming apparatus 200 according to one or more embodiments of the second example (see FIG. 1), the shaft part 42 of the supporting part 4 has a grease disposing portion 42*b*.

The grease disposing portion 42*b* is formed in a position separated in the Y1 direction from the sliding portion of the stopper 3 and the shaft part 42. In other words, the stopper 3 is disposed in a different location from the grease disposing portion 42*b*. Furthermore, the grease disposing portion 42*b* is configured to be pivotably connected to the main body unit 41 of the supporting part 4 having grease applied thereon. Note that the sliding portion of the stopper 3 and the shaft part 42 does not have grease applied thereon.

Note that the other configurations of the second example are similar to the first example.

Effects of the Second Example

In one or more embodiments of the second example, the following effects can be obtained.

In one or more embodiments of the second example, as described above, a grease disposing portion 42*b* for applying grease is provided on the shaft part 42, and the stopper 3 is disposed in a different location than the grease disposing portion 42*b*. By this, because the grease disposing portion 42*b* is separated from the sliding portion of the stopper 3 and the shaft part 42, grease is suppressed from adhering to the sliding portion of the stopper 3 and the shaft part 42. As a result, the stopper 3 is suppressed from becoming difficult to pivot with respect to the shaft part 42 due to the viscosity of the grease.

Note that other effects of the second example are similar to the first example.

Third Example

Next, an image forming apparatus 300 in one or more embodiments of the third example will be described referring to FIG. 1 and FIG. 9. An example will be described in the third example in which a spring 6 (coil spring) is provided that energizes the stopper 3 in a predetermined pivot direction in addition to the configuration of the first example. Note that the image forming apparatus 300 is one example of a "feeding apparatus." Furthermore, the spring 6 is one example of a "biasing portion" in the scope of the claims.

Figure 9:
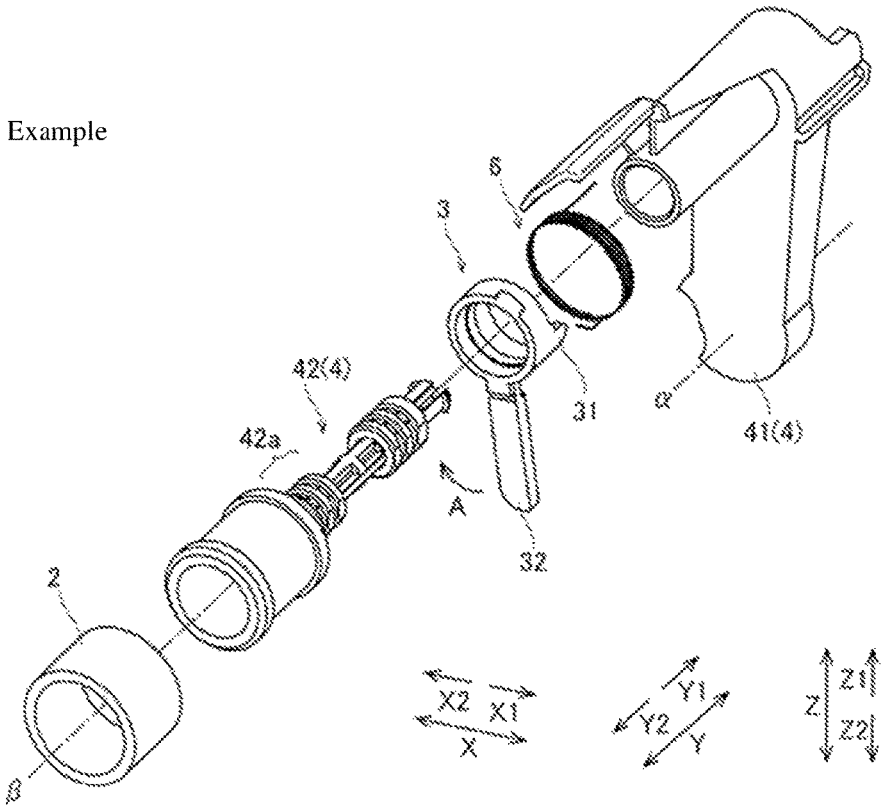
FIG. 9 is an exploded perspective view of the paper feeder of the image forming apparatus according to one or more embodiments of the present invention.

As illustrated in FIG. 9, the image forming apparatus 300 according to one or more embodiments of the third example (see FIG. 1) is provided with a spring 6.

The spring 6 is configured to energize the stopper 3 in a direction A in which the tip end portion of the stopper 3 heads to the first surface 13*a* (installed sheets P side) The spring 6 is a coil spring. Furthermore, the spring 6 is configured to energize the stopper 3 with a level of force that does not inhibit movement of the stopper 3 by the sheets P when the stopper 3 is pressed toward the downstream side of the conveying direction by the fed uppermost sheet P when paper is being fed. In other words, the spring 6 is configured to energize the stopper 3 using a level of force that does not overcome the force by which the paper feeding roller 2 sends the sheet P. Note that the spring 6 has one end contacting the stopper 3, the other end being fixed to the main body unit 41 of the supporting part 4.

Note that the other configurations of the third example are similar to the first example.

Effects of the Third Example

In one or more embodiments of the third example, the following effects can be obtained.

In one or more embodiments of the third example, as described above, the spring 6 is provided on the shaft part 42, and the stopper 3 is energized toward the paper feeding tray 13 by the spring 6. By this, the (tip end portion of the) stopper 3 is suppressed from being disposed further on the downstream side in the conveying direction of the sheets P than the regulating part 5 due to the spring 6. In other words, when the paper feeding roller 2 is in the retreating position (state in which the sheets P are installed), the stopper 3 can be prevented from withdrawing from the paper feeding path without the stopper 3 being regulated by the regulating part 5. That is, the stopper 3 is suppressed from not functioning when the sheets P are being installed.

Note that other effects of the third example are similar to the first example.

Fourth Example

Next, an image forming apparatus 400 in one or more embodiments of the fourth example will be described referring to FIG. 1 and FIG. 10. In the fourth example, it is configured so that the supporting part 4 carries out a retreating operation every time the paper feeding operation is complete, in addition to the configuration of the first example. Note that the image forming apparatus 400 is one example of a "feeding apparatus." Furthermore, the retreating operation is one example of a "predetermined operation."

Figure 10:
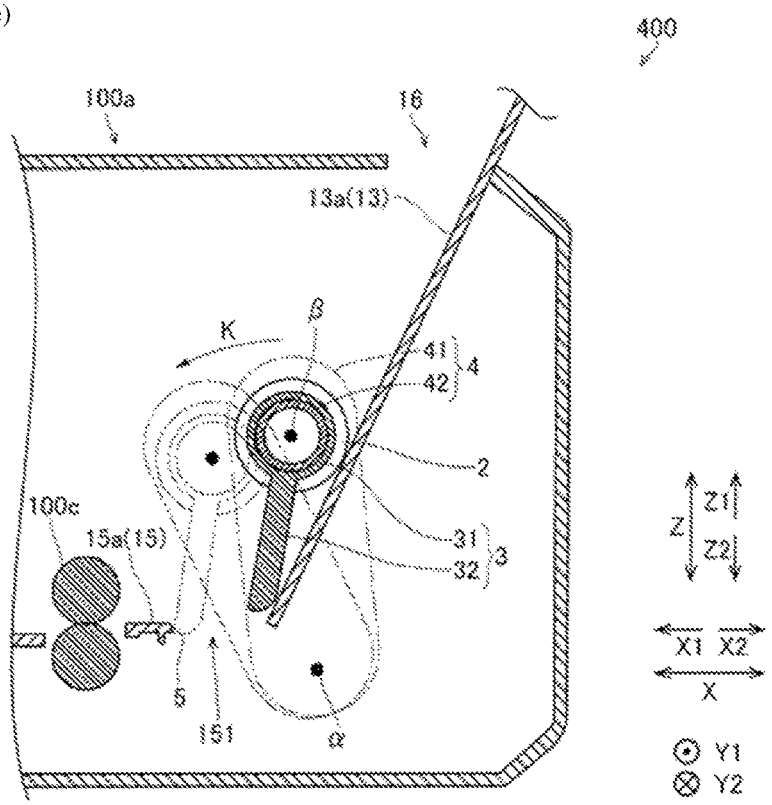
FIG. 10 is a diagram for describing the retreating operation of the image forming apparatus according to one or more embodiments of the present invention.

As illustrated in FIG. 10, in the image forming apparatus 400 according to one or more embodiments of the fourth example (see FIG. 1), the supporting part 4 is configured to carry out a retreating operation that moves the paper feeding roller 2 from the retreating position to the paper feeding position and also moves from the paper feeding position to the retreating position every time the paper feeding operation is completed. For example, the supporting part 4 rocks the paper feeding roller 2 in a K direction, and the paper feeding operation is complete. At this time, there are cases wherein the supporting part 4 completes the movement to the retreating position while a sheet P is being conveyed. In this case, the stopper 3 tries to return to its original position due to its own weight when the conveying of the sheet P is complete. However, because the regulating part 5 is there, it stops on a position on top of the regulating part 5. In other words, the tip end portion of the stopper 3 is disposed further on the downstream side in the conveying direction than the regulating part 5. In the position on top of the regulating part 5, movement of sheets P downstream in the conveying direction of the stopper 3 is not regulated, and the primary movement for regulating the sheets P is not carried out. To prevent such conditions, a supporting part 4 is configured to swing the paper feeding roller 2 from the retreating position to the paper feeding position and again swing the paper feeding roller 2 from the paper feeding position to the retreating position after the paper feeding operation is complete (complete at the time the paper feeding roller 2 separates from the sheets P or the paper feeding tray 13 and moved to the retreating position).

Note that other effects of the fourth example are similar to the first example.

Effects of the Fourth Example

In one or more embodiments of the fourth example, the following effects can be obtained.

In one or more embodiments of the fourth example, as described above, the supporting part 4 is configured to carry out a predetermined operation for moving the paper feeding roller 2 from the retreating position to the paper feeding position and also moving from the paper feeding position to the retreating position every time the paper feeding operation is completed. By this, the stopper 3 on top of the regulating part 5 can be returned to the initial position (upstream side in the conveying direction of the regulating part 5) along with the movement of the stopper 3 to the retreating position by the supporting part 4.

Note that other effects of the fourth example are similar to the first example.

(Variation)

Note that it should be considered that the currently disclosed embodiments are merely examples, and are not limiting. The scope of the present invention is shown not by the description of the embodiments above, but the scope of the claims, and all changes (modifications) within the scope of the patent claims and equal scopes and meanings are included.

Figure 11:
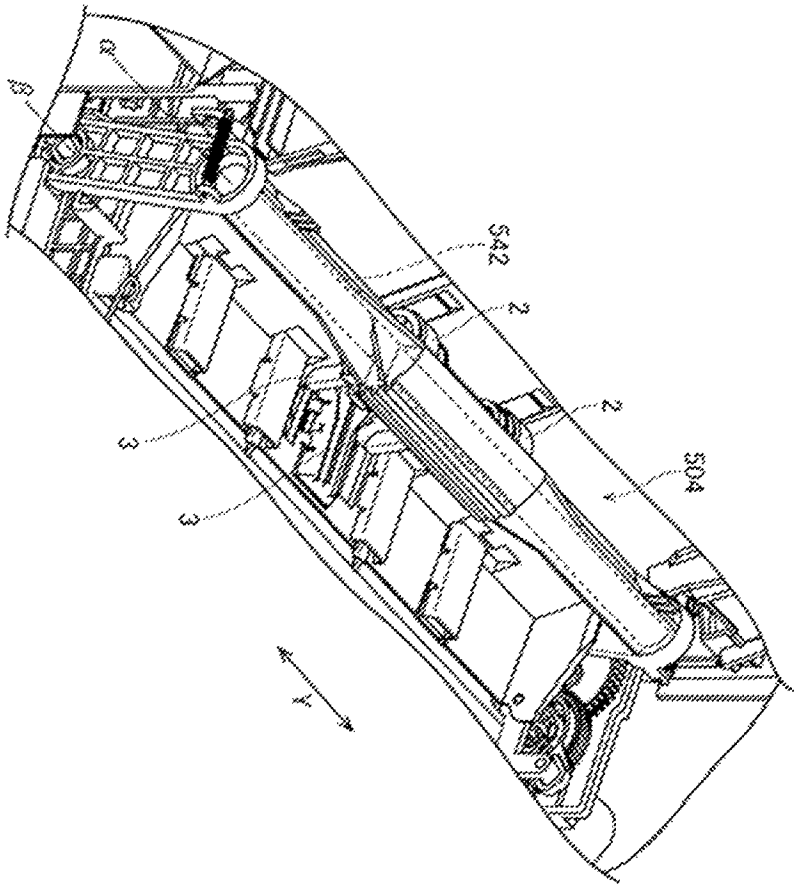
FIG. 11 is a partially expanded diagram illustrating the center impeller-shaped supporting part of the image forming apparatus according to one or more embodiments of the present invention.

For example, an embodiment is shown in the first through fourth examples wherein the supporting part is configured in a cantilever shape, but the present invention is not limited to this. In one or more embodiments of the present invention, a supporting part 504 may be configured in a center impeller shape as in the variation illustrated in FIG. 11. For example, the supporting part 504 may be configured in a center impeller shape that supports a paper feeding roller 2 from both sides in the axial direction (Y direction) of the shaft part 542. At this time, two stoppers 3 are provided on the shaft part 542. Furthermore, the stoppers 3 are provided on the inner side of the axial direction (Y direction) of the shaft part 542. Two paper feeding rollers 2 are also provided on the shaft part 542. Note that one, or three or more paper rollers may also be provided.

Furthermore, an embodiment is shown in the third example wherein the biasing portion of the present invention is configured by a spring, but the present invention is not limited to this. In one or more embodiments of the present invention, the biasing portion may also be configured by objects other than a spring such as rubber.

Furthermore, an embodiment is shown in the second example wherein a grease disposing portion is provided, an embodiment is shown in the third example wherein a biasing portion is provided, and an embodiment is shown in the fourth example configured so that a paper feeding roller operates in reverse rotation, but these configurations may be combined with other embodiments.

Furthermore, one or more embodiments are shown in the first through fourth examples wherein the second surface is provided substantially horizontal, but the present invention is not limited to this. In one or more embodiments of the present invention, the second surface may be provided inclined from the horizontal direction.

Furthermore, one or more embodiments are shown in the first through fourth examples wherein the paper feeding roller and stopper are provided near one side (Y1 direction) in the width direction of the first surface, but the present invention is not limited to this. In one or more embodiments of the present invention, the shaft part may be configured longer, and the paper feeding roller and stopper may be provided on the center of the width direction (Y direction) of the first surface.

Furthermore, one or more embodiments are shown in the first through fourth examples wherein the contacting portion of the stopper is formed in a rod shape, but the present invention is not limited to this. In one or more embodiments of the present invention, the contacting portion of the stopper may be formed in a shape other than a rod shape, such as a flat plate shape.

Furthermore, one or more embodiments are shown in the first through fourth examples wherein the stopper is disposed further on the sliding portion side than the paper feeding roller in the axial direction, but the present invention is not limited to this. In one or more embodiments of the present invention, the paper feeding roller may be disposed further on the sliding portion side than the stopper in the axial direction.

Furthermore, one or more embodiments are shown in the first through fourth examples wherein the regulating part is configured by an edge portion of the opening portion provided on the second surface, but the present invention is not limited to this. In one or more embodiments of the present invention, the regulating part may be configured by an object other than an edge portion of an opening portion, such as a protruding portion provided on the second surface.

Furthermore, one or more embodiments are shown in the first through fourth examples wherein the stopper is disposed further on the main body unit side than the paper feeding roller, but the present invention is not limited to this. In one or more embodiments of the present invention, the paper feeding roller may be disposed further on the main body unit side than the stopper.

Furthermore, one or more embodiments are shown in the first through fourth examples wherein the paper feeding roller and stopper are configured to move in a curve due to the pivoting of the supporting part that is the supporting point of the pivotal center of the supporting part, but the present invention is not limited to this. In one or more embodiments of the present invention, the paper feeding roller and stopper may be configured to move in a straight line by the movement of the supporting part in a straight line.

Furthermore, one or more embodiments are shown in the first through fourth examples wherein sheets of paper are used as the medium of the present invention, but the present invention is not limited to this. In one or more embodiments of the present invention, a medium other than sheets of papers are used as the medium of the present invention, such as a sheet used on an overhead projector (OHP).

Furthermore, one or more embodiments are shown in the first through fourth examples wherein the feeding apparatus is applied to an image forming apparatus, but the present invention is not limited to this. In one or more embodiments of the present invention, the feeding apparatus of the present invention may be applied to a feeding apparatus other than that of an image forming apparatus, such as a scanner.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

DESCRIPTION OF THE REFERENCE NUMERALS

2 Paper feeding roller
3 Stopper
4, 504 Supporting part
5 Regulating part
6 Spring (biasing portion)
13 Paper feeding tray (mounting portion)
31 Attaching portion
32 Contacting portion
41 Main body (unit)
42, 542 Shaft (part)
42*b* Grease disposing portion
100, 200, 300, 400 Image forming apparatus (feeding apparatus)
100*a* Housing
100*b* Paper feeder
151 Opening portion
152, 154 Sliding portion
153 Friction portion
P Sheet or Paper (medium)
α Pivotal center of the supporting part (pivotal axis)
β Rotational center of the paper feeding roller (rotational axis)

What is claimed is:

1. A feeding apparatus comprising:
a mounting portion that holds a medium;
a first feeding roller that feeds the medium toward a feeding direction;
a first stopper that prevents the medium from moving toward the feeding direction,
wherein the first stopper pivots with respect to a pivotal axis, and the pivotal axis of the first stopper is substantially identical with a rotational axis of the first feeding roller;
a supporting part that swings the first feeding roller between:
a first position in which the first feeding roller feeds the medium while both the first feeding roller and the first stopper contact the medium, and
a second position in which the first feeding roller does not contact the medium while the first stopper contacts the medium to prevent the medium from moving toward the feeding direction; and
a regulating part disposed on a downstream side in feeding direction with respect to a pivotal center of the supporting part,
wherein the regulating part regulates movement of the first stopper by contacting a portion of the first stopper that does not contact the medium in the first position.

2. The feeding apparatus according to claim 1, wherein a length from the pivotal axis to a tip end portion of the first stopper is shorter than a first distance between the pivotal axis in the first position and the regulating part, and is longer than a second distance between the pivotal axis in the second position and the regulating part.

3. The feeding apparatus according to claim 1,
wherein the supporting part comprises a shaft disposed along the rotational axis of the first feeding roller, and
wherein the supporting part swings the shaft between the first position and the second position by pivoting with respect to a pivotal axis of the supporting part.

4. The feeding apparatus according to claim 3, wherein the pivotal axis of the supporting part is located upstream in the feeding direction with respect to the regulating part.

5. The feeding apparatus according to claim 1, further comprising:
a housing,
wherein the regulating part is embedded in the housing.

6. The feeding apparatus according to claim 5,
wherein the housing comprises an opening portion, and
wherein the regulating part is formed at an edge portion of the opening portion on the downstream side.

7. The feeding apparatus according to claim 5,
wherein the supporting part comprises a shaft disposed along the rotational axis of the first feeding roller, and
wherein the first stopper comprises:
an attaching portion that passes through the shaft, and
a contacting portion that contacts the medium.

8. The feeding apparatus according to claim 7, wherein there is a gap between the attaching portion and the shaft.

9. The feeding apparatus according to claim 7, wherein the contacting portion has a rounded shape on a side that contacts the medium.

10. The feeding apparatus according to claim 7,
wherein the shaft includes a grease disposing portion for grease to be applied, and
wherein the first stopper is disposed on a position of the shaft other than the grease disposing portion.

11. The feeding apparatus according to claim 7,
wherein the supporting part comprises a main body that rotatably supports the shaft, and wherein the first stopper is disposed between the main body and the first feeding roller in an axial direction of the shaft.

12. The feeding apparatus according to claim 7, wherein the shaft comprises a biasing portion that biases the first stopper toward the mounting portion.

13. The feeding apparatus according to claim 7, wherein the mounting portion comprises a friction portion and a sliding portion that contact the medium, and wherein the first stopper is disposed between the friction portion and the sliding portion in an axial direction of the shaft.

14. The feeding apparatus according to claim 7, further comprises:

a second feed roller and a second stopper, wherein the supporting part supports the first and second feeding rollers from both sides of the shaft in an axial direction of the shaft, and wherein the first and second stoppers are disposed between the first and second feeding rollers.

15. The feeding apparatus according to claim 1, wherein every time when feeding of the medium has completed, the supporting part moves the first feeding roller from the second position to the first position, and then moves the first feeding roller from the first position to the second position.

* * * * *